US005499676A

United States Patent [19]

Cesaroni

[11] Patent Number: 5,499,676

[45] Date of Patent: Mar. 19, 1996

[54] MULTI-PANELLED HEAT EXCHANGER

[75] Inventor: Anthony J. Cesaroni, 9 Heathmore Court, Unionville, Ontario, Canada, L3R 8J1

[73] Assignee: Anthony J. Cesaroni, Unionville, Canada

[21] Appl. No.: 264,604

[22] Filed: Jun. 23, 1994

[30] Foreign Application Priority Data

Jun. 24, 1993 [GB] United Kingdom ..... 9313093

[51] Int. Cl.[6] ..... F28F 3/00; F28F 1/32

[52] U.S. Cl. ..... 165/166; 165/76; 165/171

[58] Field of Search ..... 165/168, 166, 165/171, 76, 165, 170; 29/890.04, 890.042

[56] References Cited

U.S. PATENT DOCUMENTS

| | | | |
|---|---|---|---|
| 2,091,584 | 8/1937 | Brown | 165/171 X |
| 3,117,621 | 1/1964 | Bockhorst | 165/171 X |
| 4,069,811 | 1/1978 | Tabor | 165/171 X |
| 4,080,702 | 3/1978 | Chatfield et al. | 29/890.042 |
| 4,406,130 | 9/1983 | Hemmerich | 165/171 X |
| 4,569,391 | 2/1986 | Hulswitt et al. | 165/166 |
| 5,050,671 | 9/1991 | Fletcher | 165/166 |

FOREIGN PATENT DOCUMENTS

| | | | |
|---|---|---|---|
| 2335652 | 1/1975 | Germany | 165/165 |

*Primary Examiner*—Martin P. Schwadron
*Assistant Examiner*—L. R. Leo

[57] ABSTRACT

A panel heat exchanger is disclosed. The panel heat exchanger has a plurality of parallel tubes in a spaced apart side-by-side relationship, the tubes being located between two plastic sheets that envelope and conform to the shape of the tubes so as to maintain said tubes in the side-by-side relationship. The sheets being bonded together between said tubes. One end of each of the plurality of tubes is in fluid flow communication with an inlet manifold and the other end of each of the plurality of tubes is in fluid flow communication with an outlet manifold. Each panel is wave-like in shape with peaks and troughs extending across the width of the panel. One face of each panel has at least one nodule located in each of said troughs, each nodule having a size such that it will contact the immediately adjacent panel in a multi-panelled heat exchanger without significantly increasing the overall thickness of the multi-panelled heat exchanger. The panel heat exchanger may be used in a variety of uses, including automotive uses. It is less susceptible to emission of whistling noises in use in high air flows.

13 Claims, 2 Drawing Sheets

MULTI-PANELLED HEAT EXCHANGER

The present invention relates to a multi-panelled heat exchanger, and especially to a multi-panelled heat exchanger that is less susceptible to producing audible sounds e.g. whistling noises, in use. Preferably, all of the heat exchanger is formed from a thermoplastic polymer. In embodiments, the multi-panelled heat exchanger is in the form of a radiator for an automobile.

Panel heat exchangers formed from thermoplastic polymers and methods for the manufacture of such heat exchangers are known. For instance, a number of heat exchangers formed from thermoplastic polymers and methods for the manufacture thereof are disclosed in PCT patent application WO91/02209 of A. J. Cesaroni, published 1991 Feb. 21, and in the published patent applications referred to therein. A preferred material of construction is aliphatic polyamide.

Multi-panelled heat exchangers are formed from individual panel heat exchangers by stacking. The result is akin to a laminar structure but with each panel heat exchanger retaining its integrity i.e. air may pass between the individual panels of the multi-panelled heat exchanger. It has been found that multi-panelled heat exchangers formed from thermoplastic polymers have a tendency to emit audible noise, e.g. a whistling sound, when used in a manner in which a strong air flow passes through the panel heat exchanger. Such a method of use occurs, for instance, in a automobile, where the strong air flow results from the motion of the automobile.

A multi-panelled heat exchanger formed from tubes and sheet and which is less susceptible to generation of audible noise has now been found.

Accordingly, in one aspect the present invention provides a multi-panelled heat exchanger comprising: a plurality of panels in a laminar stacked arrangement; each of said panels being formed from a plurality of parallel tubes in a spaced apart side-by-side relationship, said tubes being maintained in the side-by-side relationship by intervening sheet, thereby forming a panel of tubes and sheet; each of said panels having an inlet manifold and an outlet manifold at opposed ends thereof, the inlet manifolds of the multi-panelled heat exchanger being interconnected in fluid-flow relationship and the outlet manifolds of the multi-panelled heat exchanger being interconnected in fluid flow relationship; each of said plurality of tubes of each panel being bonded at opposing ends thereof to said manifolds such that one end of each of said plurality of tubes is in fluid flow communication with the inlet manifold and the other end of each of said plurality of tubes is in fluid flow communication with the outlet manifold; each panel being wave-like in shape with peaks and troughs extending across the width of the panel; one face of each panel having at least one nodule located in each of said troughs, each nodule having a size such that it will contact the immediately adjacent panel in a multi-panelled heat exchanger without significantly increasing the overall thickness of the multi-panelled heat exchanger.

In another aspect, the present invention provides a multi-panelled heat exchanger comprising: a plurality of panels in a laminar stacked arrangement; each of said panels being formed from a plurality of parallel tubes in a spaced apart side-by-side relationship, said tubes being located between two plastic sheets that envelope and conform to the shape of the tubes so as to maintain said tubes in the side-by-side relationship, said sheets being bonded together between said tubes; each of said panels having an inlet manifold and an outlet manifold at opposed ends thereof, the inlet manifolds of the multi-panelled heat exchanger being interconnected in fluid-flow relationship and the outlet manifolds of the multi-panelled heat exchanger being interconnected in fluid flow relationship; each of said plurality of tubes of each panel being bonded at opposing ends thereof to said manifolds such that one end of each of said plurality of tubes is in fluid flow communication with the inlet manifold and the other end of each of said plurality of tubes is in fluid flow communication with the outlet manifold; each panel being wave-like in shape with peaks and troughs extending across the width of the panel; one face of each panel having at least one nodule located in each of said troughs, each nodule having a size such that it will contact the immediately adjacent panel in a multi-panelled heat exchanger without significantly increasing the overall thickness of the multi-panelled heat exchanger.

In a preferred embodiment of the multi-panelled heat exchanger of the present invention, the nodules are spherical and bonded to the exterior surface of each said panel.

In another embodiment, the combined thickness of the nodule and the two sheets forming the panel is substantially the same as the thickness of the manifold.

In yet another embodiment, the sheets are bonded to the tubes.

In a still further embodiment, the tubes are sinusoidal in shape.

The present invention relates to multi-panelled heat exchangers. The heat exchanger is formed from a plurality of panels by bonding the panels together in a laminar manner, with nodules on the individual panels.

The invention will be described with particular reference to the embodiments shown in the drawings in which.

Figure 1:
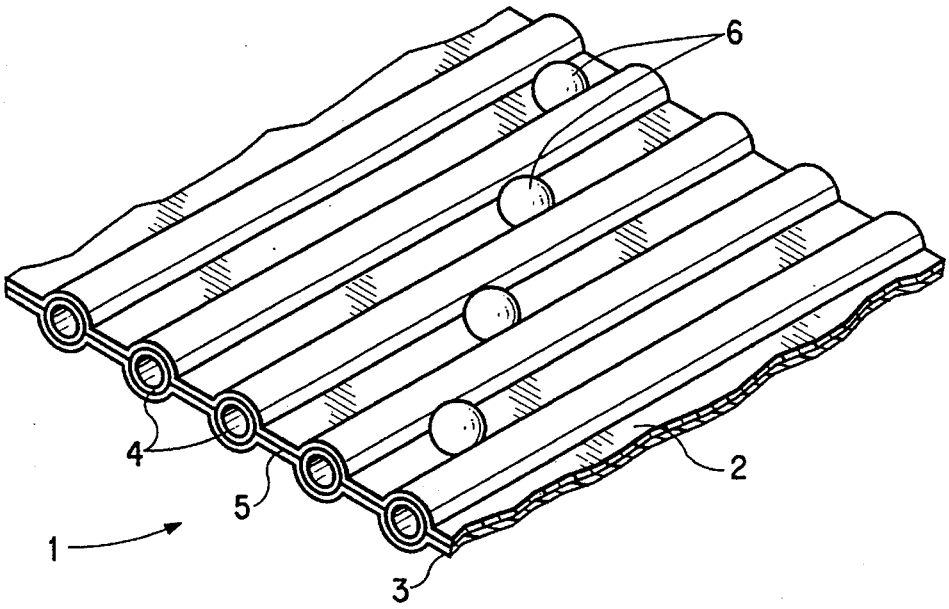
FIG. 1 is a schematic representation of a section of a panel showing nodules.

Referring to FIG. 1, a panel (generally indicated by 1) is shown with sheets conforming to the shape of the tubes. Tubes 4 are located between upper sheet 2 and lower sheet 3, with both sheets enveloping tubes 4 and conforming to the shape thereof. Upper sheet 2 is bonded to lower sheet 3 at bonds 5 located between tubes 4. Tubes 4 are in a side-by-side relationship, and maintained in that relationship by upper sheet 2 and lower sheet 3 being bonded together at bonds 5 between tubes 4. Tubes 4 are wave-like or sinusoidal in shape, forming peaks and troughs along the length of the panel.

Nodules 6 are located between tubes 4. As shown nodules 6 are in the form of spheres, which is the preferred embodiment of the invention; as more clearly seen in FIG. 4, nodules 6 are on the surface of upper sheet 2 at the location of bonds 5 i.e. between tubes 4, and are not formed as part of upper sheet 2. Nodules 6 are located in the troughs of the panels and between tubes 4, i.e. they are located at the location of bonds 5 and not on tubes 4.

Figure 2:
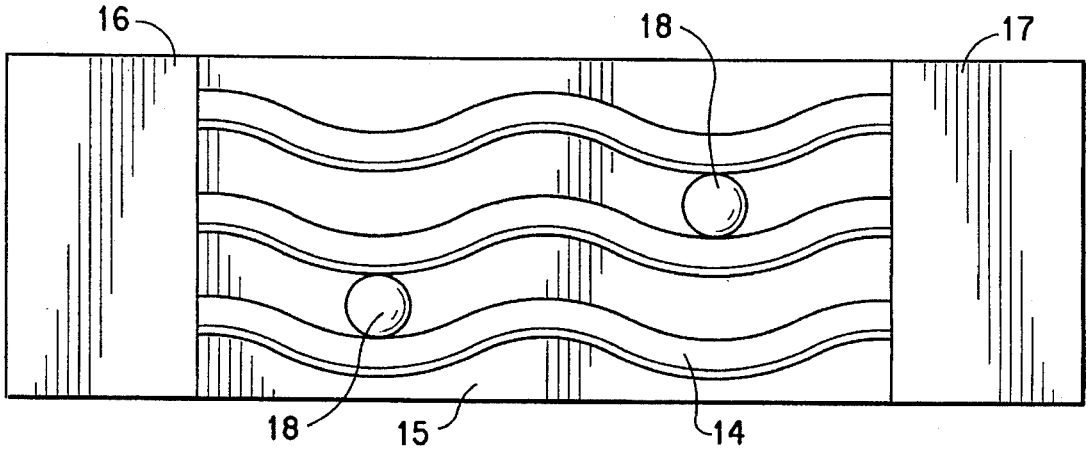
FIG. 2 is a plan view of tubes and sheet with manifold in which the tubes are sinusoidal, with nodules located between the tubes and in troughs.

Tubes 4 are linear when viewed in a plan view directly from above or below the panel. However, tubes 4 are in a side-by-side relationship with each tube being sinusoidal rather than linear, as shown in FIG. 2. FIG. 2 shows a plan view of sinusoidal tubes 14 enveloped in sheet 15 and extending between inlet manifold 16 and outlet manifold 17. Nodules 18 are shown located between tubes 14.

Figure 3:
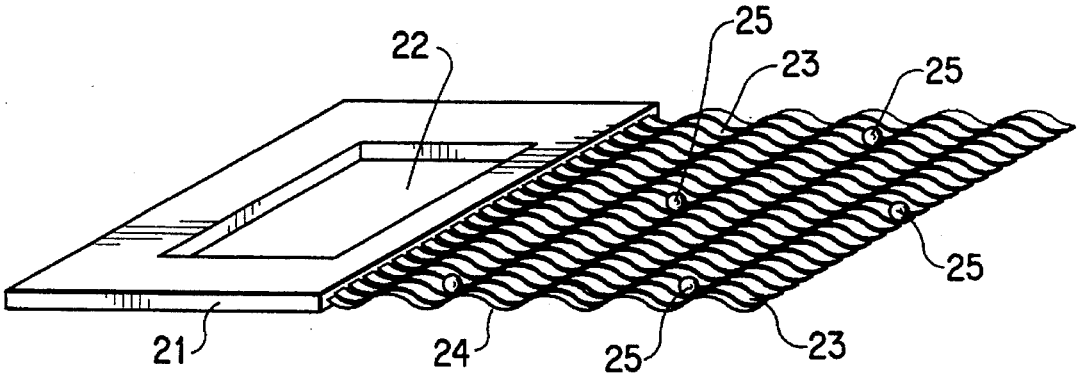
FIG. 3 is a schematic representation of an elevated view showing disposition of nodules between tubes.

FIG. 3 shows a manifold 21 having an opening 22 for flow of fluid into or out of tubes 23. Tubes 23 are enveloped in sheet 24. Tubes 23 are sinusoidal in shape, forming a wave pattern that extends across the width of the panel; this is more readily seen in FIG. 4. Nodules 25 are located between tubes 23.

Figure 4:
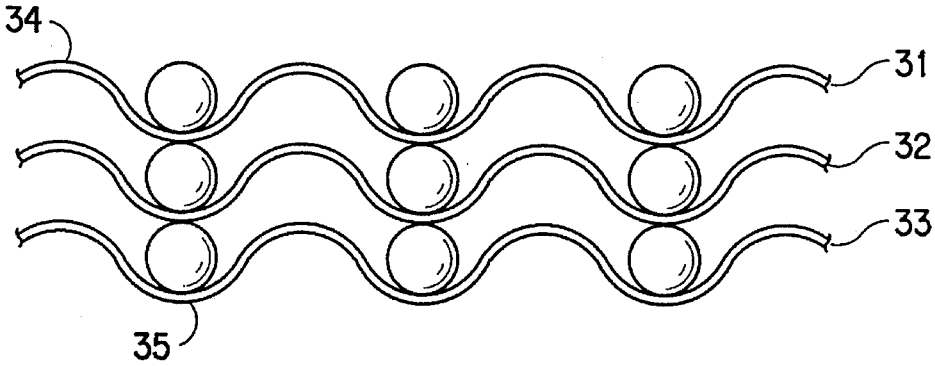
FIG. 4 is a schematic-representation of a side view of multiple panels of a multi-panelled heat exchanger.

FIG. 4 shows a side view of the multi-panelled heat exchanger of the invention. As shown, there are three panels, identified as 31, 32 and 33, although in practice there would normally be many more panels in the multi-panelled heat exchanger, often at least twenty panels. Each of those panels is sinusoidal in side view, forming peaks 34 and troughs 35. Each trough 35 has a nodule 36 located therein to space apart the adjacent panels i.e. nodules 36 space panel 31 from panel 32 and space panel 32 from panel 33. The individual nodules 36 are not located vertically above and below each other, but rather scattered in a pattern that may be seen in FIG. 3, and are in troughs 35, not at peaks 34; this is the preferred embodiment. The nodules should not be aligned in rows; random or scattered location of the nodules is preferred, to prevent harmonics being formed which would lead to creation of noise.

As noted above, the nodules are preferably spherical in shape. This is believed to be preferable to enable air to flow passed the nodules and between the panels of the multi-panelled heat exchanger with minimum air resistance. Other shapes may however be used, but at least in some instances this may result in retarded air flow.

The combined thickness of the nodules and the sheets forming the panels of the multi-panelled heat exchanger should be equal or at least substantially equal to the thickness of the inlet and outlet manifolds. The latter thickness is that in the final construction of the multi-panelled heat exchanger, not at any intermediate stage. Significantly greater thickness of the nodule plus sheet, compared with the thickness of the manifold, would result in the total thickness of the panels being greater than the total thickness of the manifolds, with the consequence that the multi-panel heat exchanger would be bowed in shape. Conversely, if the thickness of the nodule plus sheet was significantly less than the thickness of the manifolds, then the nodules would not contact the adjacent panel, thereby permitting that panel to vibrate and create noise. Having the nodule in contact with the adjacent panel is believed to de-tune the panels and stop the generation of noise. It will be noted that the nodules are located in troughs in the panel, not at the peaks; this is the preferred location of the nodules, especially for convenience, strength of the nodule and maintenance of integrity of tubes.

A number of fabrication techniques may be used to fabricate the panels described herein. For instance, a plurality of tubes 4 may be placed between upper sheet 2 and lower sheet 3. Tubes 4 may be discrete tubes of the desired length or tubes 4 may be in the form of continuous lengths of tubing that are laid down in the required manner and subsequent to being conformed into place between the upper and lower sheets, cut to the desired length. Sheets 2 and 3 may be conformed to the shape of the tubes 4 and bonded together between tubes 4 by use of a heated press e.g. a heated press with platens having grooves to facilitate location of the tubing in its side-by side relationship. Heat and pressure may be used to bond the upper and lower sheets together, optionally with use of an adhesive to facilitate bonding. Preferably, the sheets are also bonded to the tubing, as this helps maintain the tubing in position. During the bonding step, it is important to maintain the integrity of the tubing. This may require suitable selection of the material of the tubing and sheet and/or use of adhesives so that bonding of the sheets may be effected without, for example, collapsing the tubing. An inert gas pressure may be applied to the inside of the tubing to assist in maintaining the integrity of the tubing. The tubing and sheets may be fabricated from the same material or from different materials, depending in particular on the environments and other conditions of operation with respect to the tubing and the sheet.

The panels may also be fabricated using continuous processes.

The combination of sheet and tubing may then be bonded to the manifold. Techniques to do so are known. The design of the manifolds is selected depending on the construction of the heat exchanger and the desired flow pattern through the heat exchanger.

The nodules are added in a separate step. The nodules are coated with a suitable adhesive for bonding to the sheets of the panel, and then placed in position. Alternately, the nodules could be heated to a temperature to effect bonding. Use of adhesive is preferred.

In operation, fluid would enter the inlet manifold, pass through tubes to outlet manifold. The panel heat exchanger would normally have the manifolds of a construction such that fluid passed several times from one side of the panel heat exchanger to the other e.g. in a zig-zag manner, to increase the efficiency and effectiveness of the operation of the panel heat exchanger.

The sheets may be formed from a variety of polymer compositions. The composition selected will depend primarily on the end use intended for the heat exchanger, especially the temperature of use and the environment of use, including the fluid that will be passed through the heat exchanger and the fluid e.g. air, external to the heat exchanger. In the case of use on a vehicle, the fluid may be air that at times contains salt or other corrosive or abrasive matter, or the fluid may be liquid e.g. radiator fluid. While it is preferred to use the same or similar polymer compositions for both sheet and tubing, the sheets and tubes may be fabricated from different polymers, the requirement being that acceptable bonding may be achieved.

A preferred polymer of construction is polyamide. Examples of polyamides are the polyamides formed by the condensation polymerization of an aliphatic dicarboxylic acid having 6–12 carbon atoms with an aliphatic primary diamine having 6–12 carbon atoms. Alternatively, the polyamide may be formed by condensation polymerization of an aliphatic lactam or alpha,omega aminocarboxylic acid having 6–12 carbon atoms. In addition, the polyamide may be formed by copolymerization of mixtures of such dicarboxylic acids, diamines, lactams and aminocarboxylic acids. Examples of dicarboxylic acids are 1,6-hexanedioic acid (adipic acid), 1,7-heptanedioic acid (pimelic acid), 1,8-octanedioic acid (suberic acid), 1,9-nonanedioic acid (azelaic acid), 1,10-decanedioic acid (sebacic acid) and 1,12-dodecanedioic acid. Examples of diamines are 1,6-hexamethylene diamine, 2-methyl pentamethylene diamine, 1,8-octamethylene diamine, 1,10-decamethylene diamine and 1,12-dodecamethylene diamine. An example of a lactam is caprolactam. Examples of alpha,omega aminocarboxylic acids are amino octanoic acid, amino decanoic acid and amino dodecanoic acid. Preferred examples of the polyamides are polyhexamethylene adipamide and polycaprolactam, which are also known as nylon 66 and nylon 6, respectively.

The multi-panelled heat exchangers of the present invention have been described with particular reference to the use of polyamides as the polymer used in the fabrication thereof. It is to be understood, however, that other polymers may be used, the principal consideration being the environment of use of the heat exchanger e.g. the properties of the fluid passing through and over the heat exchanger, the temperature and pressure of use and the like. Examples of other thermoplastic polymers that may be used are polyethylene, polypropylene, fluorocarbon polymers, polyesters, thermoplastic and thermoset elastomers e.g. polyetherester elastomers, neoprene, chlorosulphonated polyethylene, and ethylene/propylene/diene (EPDM) elastomers, polyvinyl chloride and polyurethane. It is to be understood that the tubing could be metallic tubing, although plastic tubing is preferred.

In preferred embodiments of the present invention, the combined thickness of sheet and tubing used in the fabrication of the multi-panelled heat exchanger i.e. the thickness as measured from inside the tube to the exterior of the panel, is less than 0.7 mm, and especially in the range of 0.07–0.50 mm, particularly 0.12–0.30 mm. The thickness of the tubing per se will, however, depend to a significant extent on the proposed end use and especially the properties required for that end use. The sheet may be significantly thinner than the tubing as the physical demands on the sheet tend to be substantially less than on the tubing. The size requirements for the nodules has been discussed above; however, in typical examples the nodules have a height in the range of about 1.6–2.4 mm.

The polymer compositions used in the fabrication of the panel heat exchangers may contain stabilizers, pigments, fillers, including glass fibres, and the like, as will be appreciated by those skilled in the art.

The polymer composition of the tubing and of the sheet may be the same or different, depending on the intended use of the panel heat exchangers. All seals in the panel heat exchanger need to be fluid tight seals to prevent leakage of fluid from the heat exchanger.

The multi-panelled heat exchangers may be manufactured in a versatile and relatively simple manner. Simple moulds and fabrication techniques may be used, including continuous processes using rolls.

The heat exchangers may be used in a variety of end-uses, depending on the polymer(s) from which the heat exchanger has been fabricated and the intended environment of use of the heat exchanger. In embodiments, the heat exchangers may be used in automotive end uses e.g. as part of the water and oil cooling systems. While the heat exchangers may also be used in less demanding end uses e.g. in refrigeration and in comfort heat exchangers, the multi-panel heat exchangers of the invention are intended for use in situations in which there is a large flow of air through the heat exchanger e.g. as in automotive use, and to reduce the generation of noise in such situations.

The present invention is illustrated by the following examples.

EXAMPLE I

As an illustration of the invention, a panel was formed from sheet and tubes, and generally was of the shape shown in the drawings. The panel had a length of 53 cm, excluding the inlet and outlet manifolds at its ends, a width of 6.8 cm and had 20 tubes. The panel was fabricated from polyhexamethylene adipamide compositions. Both the tubing and the sheet had a thickness of 0.25 mm.

The sheet was coated with a composition of benzyl alcohol, phenol and polyamide as a bonding agent to facilitate bonding the tubing and sheet. The use of such compositions in the bonding of polyamides is described in European patent application 0 287 271 of A. J. Cesaroni, published 1988 Oct. 19.

A first sheet was laid on a platen of a press, the platens used in the press having grooves corresponding to the tubes in the panel. The tubes were then laid on the first sheet and the second sheet was laid on top. The combination of tubes and sheet was then subjected to heat and pressure between platens in the press so as to effect bonding.

The panel between the manifolds had a wave-like appearance with 43 peaks and troughs between the manifolds. The peak-trough height was about the same as the thickness of the manifolds. Nodules were placed on one face of the panel, in troughs, using adhesive to bonds the nodules to the panels. The nodules were spherical and of a size such that the top of the nodule was approximately in the same plane as the peaks of the panel. One nodules was placed in each trough in a repeating pattern, as follows: near the first edge of the panel, in the centre of the panel, near the second edge of the panel, near the first edge of the panel, in the centre of the panel etc.

A multi-panelled heat exchanger was constructed using about 130 of the panels described above. The individual panels were essentially parallel to each other, with the nodules being in contact with the immediately adjacent panel.

The multi-panelled heat exchanger was tested in a wind-tunnel using air at a velocity of up to 500 m/min. It did not emit a whistling noise. In contrast, a multi-panelled heat exchanger of the same construction but without nodules emitted a distinct whistling noise when tested in the same manner, and did so even when tested at air velocities of about 300 m/min; the appearance of whistling noise is determined in part by design of the heat exchanger and the rigidity of construction.

EXAMPLE II

Using the procedure of Example I, a multi-panelled heat exchanger having about 50 panels was constructed for use in a commercial heating duct system.

A heat exchanger without nodules emitted noise at air velocities of as low as about 90 m/min. However, the multi-panelled heat exchanger with nodules as described above had an acceptably low noise level at air velocities of up to at least 300 m/min.

I claim:

1. A multi-panelled heat exchanger comprising:

a plurality of panels in a laminar stacked arrangement;

each of said panels being formed from a plurality of parallel tubes in a spaced apart side-by-side relationship, said tubes being maintained in the side-by-side relationship by an intervening sheet, thereby forming a panel of tubes and sheet;

each of said panels having an inlet manifold and an outlet manifold at opposed ends thereof, the inlet manifolds of the multi-panelled heat exchanger being interconnected in fluid-flow relationship and the outlet manifolds of the multi-panelled heat exchanger being interconnected in fluid flow relationship;

each of said plurality of tubes of each panel being bonded at opposing ends thereof to said manifolds such that one end of each of said plurality of tubes is in fluid flow communication with the inlet manifold and the other end of each of said plurality of tubes is in fluid flow communication with the outlet manifold;

each panel being wave-like in shape with peaks and troughs extending across the width of the panel;

one face of each panel having at least one nodule located in each of said troughs, each nodule having a size such that it will contact an immediately adjacent panel in the multi-panelled heat exchanger without significantly increasing an overall thickness of the multi-panelled heat exchanger.

2. The multi-panelled heat exchanger of claim 1 in which the tubes are sinusoidal in shape.

3. The multi-panelled heat exchanger of claim 2 in which the panels are formed from a thermoplastic polymer.

4. The multi-panelled heat exchanger of claim 3 in which the polymer is polyamide.

5. The multi-panelled heat exchanger of claim 4 in which the heat exchanger is in the form of a radiator for an automobile.

6. A multi-panelled heat exchanger comprising:

a plurality of panels in a laminar stacked arrangement;

each of said panels being formed from a plurality of parallel tubes in a spaced apart side-by-side relationship, said tubes being located between two plastic sheets that envelope and conform to the shape of the tubes so as to maintain said tubes in the side-by-side relationship, said sheets being bonded together between said tubes;

each of said panels having an inlet manifold and an outlet manifold at opposed ends thereof, the inlet manifolds of the multi-panelled heat exchanger being interconnected in fluid-flow relationship and the outlet manifolds of the multi-panelled heat exchanger being interconnected in fluid flow relationship;

each of said plurality of tubes of each panel being bonded at opposing ends thereof to said manifolds such that one end of each of said plurality of tubes is in fluid flow communication with the inlet manifold and the other end of each of said plurality of tubes is in fluid flow communication with the outlet manifold;

each panel being wave-like in shape with peaks and troughs extending across the width of the panel;

one face of each panel having at least one nodule located in each of said troughs, each nodule having a size such that it will contact an immediately adjacent panel in the multi-panelled heat exchanger without significantly increasing an overall thickness of the multi-panelled heat exchanger.

7. The multi-panelled heat exchanger of claim 6 in which the nodules are spherical and bonded to an exterior surface of each said panel.

8. The multi-panelled heat exchanger of claim 7 in which a combined thickness of the nodule and the sheets is substantially the same as the thickness of the manifold.

9. The multi-panelled heat exchanger of claim 8 in which the sheets are bonded to the tubes.

10. The multi-panelled heat exchanger of claim 6 in which the tubes are sinusoidal in shape.

11. The multi-panelled heat exchanger of claim 10 in which the panels are formed from a thermoplastic polymer.

12. The multi-panelled heat exchanger of claim 11 in which the polymer is polyamide.

13. The multi-panelled heat exchanger of claim 12 in which the heat exchanger is in the form of a radiator for an automobile.

* * * * *